US005450645A

United States Patent [19]

Atkins

[11] Patent Number: 5,450,645

[45] Date of Patent: Sep. 19, 1995

[54] SWIMMING POOL CLEANER OPERATING HEAD

[75] Inventor: David S. Atkins, Broederstroom, South Africa

[73] Assignee: Zarina Holdings, C.V., Amsterdam, Netherlands

[21] Appl. No.: 271,366

[22] Filed: Jul. 6, 1994

[30] Foreign Application Priority Data

Jul. 9, 1993 [ZA] South Africa ..... 93/4943

[51] Int. Cl.[6] ..... E04H 4/16; F16K 15/14

[52] U.S. Cl. ..... 15/1.7; 137/846

[58] Field of Search ..... 15/1.7, 404; 137/843, 137/846

[56] References Cited

U.S. PATENT DOCUMENTS

| | | | |
|---|---|---|---|
| 225,776 | 3/1880 | Wilson . | |
| 844,410 | 2/1907 | Schauer . | |
| 2,467,150 | 4/1949 | Nordell . | |
| 2,590,215 | 3/1952 | Sausa . | |
| 2,764,183 | 9/1956 | Gollehon . | |
| 3,353,560 | 11/1967 | McCulloch . | |
| 3,469,582 | 9/1969 | Jackson . | |
| 3,514,034 | 5/1970 | Cushman . | |
| 3,886,937 | 6/1975 | Bobo et al. . | |
| 4,133,068 | 1/1979 | Hofmann | 15/404 |
| 4,195,810 | 4/1980 | Lavin . | |
| 4,642,833 | 2/1987 | Stoltz et al. . | |
| 4,684,364 | 8/1987 | Sawyer et al. . | |
| 4,742,593 | 5/1988 | Kallenbach | 15/1.7 |
| 4,761,848 | 8/1988 | Hofmann | 15/1.7 |
| 4,769,867 | 9/1988 | Stoltz . | |
| 5,014,382 | 5/1991 | Kallenbach . | |
| 5,315,728 | 5/1994 | Atkins . | |

FOREIGN PATENT DOCUMENTS

| | | | |
|---|---|---|---|
| 0205697 | 12/1986 | European Pat. Off. | 15/1.7 |
| 204979 | 12/1983 | Germany . | |
| 672010 | 10/1989 | Switzerland . | |
| 2093954 | 9/1982 | United Kingdom . | |
| 2172195 | 9/1986 | United Kingdom | 15/1.7 |

*Primary Examiner*—David A. Scherbel
*Assistant Examiner*—Randall E. Chin
*Attorney, Agent, or Firm*—Dean W. Russell; Mitchell G. Stockwell; Kilpatrick & Cody

[57] ABSTRACT

Swimming pool cleaner components are provided to form a unitary combination of a body housing a diaphragm in communication with an inner tube and the body in communication with an outer tube around the inner tube and secured to the body to locate the diaphragm and inner tube with a rotatable coupling collar on the outer tube to position the components in an outer body of the swimming pool cleaner.

16 Claims, 2 Drawing Sheets

SWIMMING POOL CLEANER OPERATING HEAD

FIELD OF THE INVENTION

This invention relates to components of an operating head for swimming pool cleaners. Particularly it relates to an assembly of components for cleaners which utilize a tubular resilient diaphragm as a means for interrupting fluid flow through the cleaner to provide movement over a surface to be cleaned.

BACKGROUND OF THE INVENTION

A variety of devices exist that move automatically over surfaces of swimming pools to be cleaned. One such pool cleaner operates in co-operation with the reduced pressure caused by a pump to induce debris-laden fluid within a pool to flow through the cleaner (and other filtration equipment if desired). The cleaner functions by causing a valve, or diaphragm, to oscillate, periodically interrupting the fluid flow through the cleaner. This periodic interruption in turn causes movement of the device over the surface to be cleaned. Suitable valves or diaphragms for such a fluid-interruption cleaner are described in U.S. Pat. Nos. 4,642,833 and 4,742,593, which patents are incorporated herein in their entireties by this reference.

U.S. Pat. No. 5,014,382, also incorporated herein in its entirety by this reference, discloses one such fluid-interruption version of an automatic swimming pool cleaner. As described in the patent, the cleaner preferably includes a tubular resilient diaphragm to interrupt the flow of fluid (such as water) through the cleaner during use. The diaphragm entrance is typically located adjacent the inlet foot of the cleaner, while its exit communicates with an inner tube circumscribed by the cleaner's rigid extension pipe (outer tube). Because the cleaner's exterior body (together with the inlet foot and inner tube) fix the diaphragm in position, the diaphragm is not easily removed from the cleaner for repair or replacement. Moreover, the rigid structures can accommodate only a single size diaphragm. As a result, not only must diaphragm manufacturing tolerances be minimized, but substitution of diaphragms of different lengths is precluded as well.

Even more pertinent to this invention is the disclosure in the applicant's own U.S. Pat. No. 5,315,728 and the disclosure of that patent is also included herein by reference.

OBJECT OF THE INVENTION

The object of this invention is to provide an assembly of operating components which may be freely rotatable about its axis in a body providing orientation of the assembly relative to the surface being cleaned.

SUMMARY OF THE INVENTION

According to this invention there is provided an assembly of swimming pool cleaner components comprising a hollow body having an axial inlet and outlet and housing a tubular diaphragm, an inner tubular member extending from the diaphragm out through an outer tubular member around the inner tubular member wherein the outer tube is adjustably engaged in the outer end of the body with means provided between the ends of the inner and outer tubes to locate them relative to each other and the diaphragm, and a coupling member freely rotatable around the outer member.

The invention also provides for the outer tubular member and body to be in screw-threaded engagement. The means between the inner and outer tubular members may be a cantilever ring capable of radial and longitudinal contraction. A tapered inner end to the outer tubular member fits over the cantilever ring and assists in holding it against a radially projecting rib on the inner tubular member adjacent the end of the inner tubular member engaging the diaphragm.

Further features of this invention provide for the coupling means to be a collar rotatable on the outer tubular member with an axial thrust ball bearing located between a flange on the outer tubular member and one end of the collar. The opposite end of the collar is located against a stop projecting from the outer tubular member.

A further feature of the invention provides for there to be a thrust washer between the end of the collar and the stop.

The invention also provides for the bearing components to be moulded in suitable plastics material.

Further features of this invention provide for the bearing to have a lower and upper ring each having at least three open ended ball receiving formations formed therein with a ball located within each pair of opposing ball receiving formations.

Still further features of this invention provide for the inlet end of the diaphragm to be in frictional engagement with the body and carrying a flange which abuts against the inlet end of the body.

BRIEF DESCRIPTION OF THE DRAWINGS

These and other features of this invention will be described with reference to the accompanying drawings which show in.

DETAILED DESCRIPTION OF THE INVENTION WITH REFERENCE TO THE DRAWINGS

Figure 1:
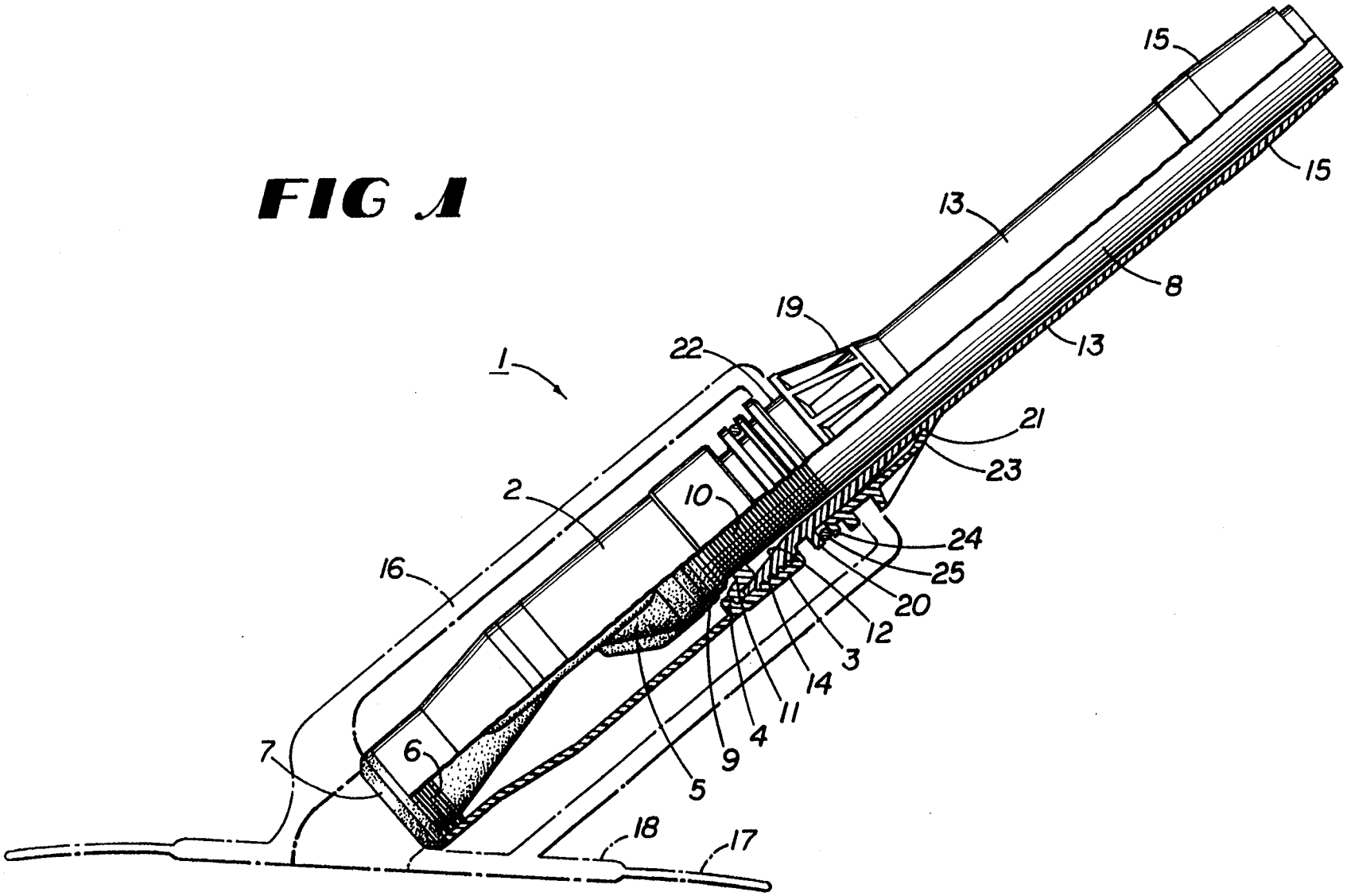
FIG. 1 a longitudinal part cross-sectional view of the components in an assembled relationship; and, in FIG. 2 a cross sectional detail of a thrust absorbing bearing.

As shown the assembled components for the operating mechanism of a swimming pool cleaner are indicated generally at (1).

They consist essentially of a hollow tubular body (2) screwthreaded at the normally upper end (3). An inwardly directed flange (4) is located below the screwthreads. Fitted into the body is the tubular diaphragm (5), the outer end of which has a series of integrally moulded ribs (6) so that the diaphragm (5) is in sealing engagement with the body and an end flange (7) located against the end of the body (2).

An inner tubular member (8) has its inner end fitted into the end of diaphragm (5) and held in position by a ring (9) engaging in a groove in the end of the diaphragm (5). This end of the inner tubular member (8) carries a series of ribs (10) Co-operating with a cantilever ring (11) in the same manner as described in our U.S. Pat. No. 5,315,728.

However, in the construction according to this invention, pressure is exerted on ring (11), by the tapered inner end (12) of an outer tubular member (13). The tubular member (13) has external screwthreads at (14) which engage the screwthreads in the upper end (3) of the body (2).

By screwing the outer tubular member (13) into the body (2), the body (2), diaphragm (5), inner tubular member (8) becomes a unitary assembly with these parts fixed in relation to each other. The diaphragm may be loaded in the manner described in our U.S. Pat. No. 5,315,728.

The outer end (15) of the outer tubular member (13) is tapered to enable it to be attached to the flexible hose extending between the pool cleaner and weir during cleaning operations.

To enable the above described assembly to be included as part of a complete pool cleaner an outer body (16) indicated in dotted lines in FIG. 1 is provided. This outer body (16) has the usual form, with a surface engaging disc (17) and inlet foot (18) permitting debris-laden water to be drawn through the cleaner to the pool filtration plant.

Repeated flexing of the diaphragm causes interruption of the flow through the cleaner and consequent random movement of the cleaner over the submerged surface to be cleaned.

To enable the cleaner hose to rotate relative to the foot (18) of the cleaner during use, a collar (19) is positioned on the outer tubular member (13) between a flange (20) and a locating stop (21) on the outer tubular member (13). A thrust washer (not shown) may be located between the collar (19) and the stop (21). The thrust washer may also take the form of a lubricating ring. The collar provides a groove (22). This groove is engaged by the upper end of the outer body (16) and the lower end of the outer body (16) locates in a recess provided in the foot (18).

The collar (19) has an outer end (23) which is resiliently flexible so that it can be forced over and engage under the locating stop (21).

The inner end of collar (19) carries a peripheral flange (24) and an axial thrust absorbing bearing (25) that is positioned between flange (24) and the flange (20) on the outer tubular member (13).

Figure 2:
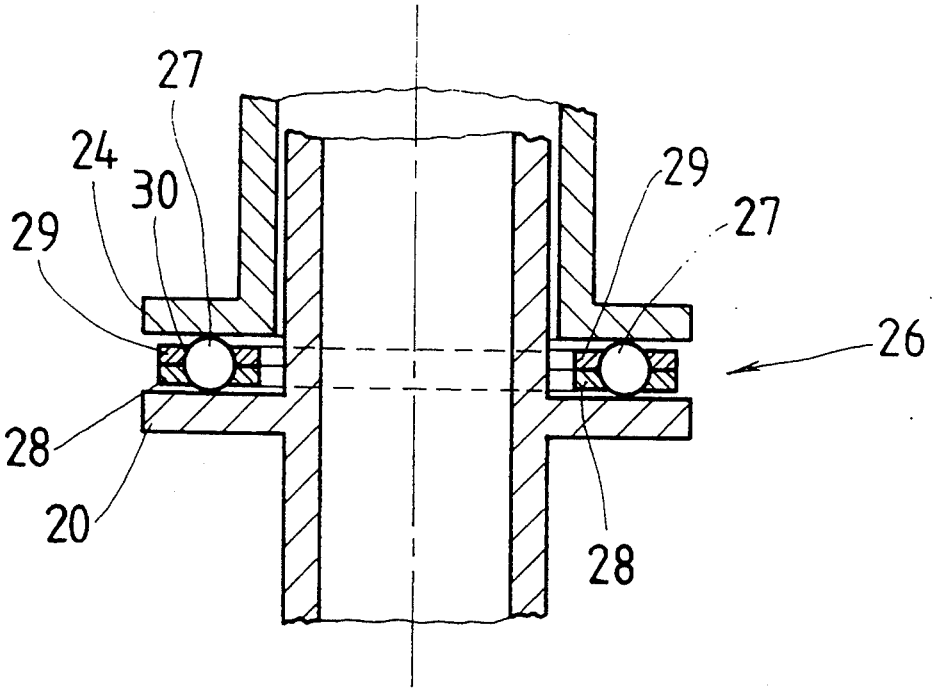

Referring to FIG. 2 the bearing (25) is a ball bearing (26) moulded from suitable plastics material and the balls (27) are preferably made from acetyl polymeric material or an acetyl synthetic resin.

The bearing (26) consists of a lower ring (28) and an upper ring (29). Each of the rings has at least three open ended ball receiving formations (30) formed therein. Suitable retaining members (not shown) are provided on the rings and the lower ring (28) and upper ring (29) are clipped together with the balls (27) located within the opposed open ended ball receiving formations (30). The balls (27) project slightly through the open ends of the ball receiving formations (30) to abut against the flanges (20) and (24) as shown in FIG. 2.

It will be appreciated that the assembled components provide the driving assembly for the cleaner and that it can be incorporated in a wide variety of outer bodies. It is easily removed from the outer body for repair or replacement of any of the individual components, particularly the diaphragm which can be removed by simply releasing the outer tubular member (13) from the body (2) and withdrawing the inner tubular member (8) and diaphragm (5) from the body (2).

It will also be appreciated that the components of this invention are assembled so that there are no leakage paths into the outer tubular member as occurs with other constructions using tubular diaphragms.

What I/We claim as new and desire to secure as Letters Patents is:

1. An assembly of swimming pool cleaner components comprising:
   a. a hollow body having an axial inlet and an axial outlet;
   b. a tubular diaphragm having inlet and outlet ends, the diaphragm housed within the body;
   c. an inner tubular member having a first end located in the outlet end of the diaphragm;
   d. an outer tubular member, positioned over the inner tubular member, and having a first end longitudinally adjustably positioned in the axial outlet of the body;
   e. means, positioned between the inner and outer tubular members and within the axial outlet of the body, for adjustably connecting the first ends of the inner and outer tubular members and the outlet end of the diaphragm relative to each other and to the axial outlet of the body; and
   f. a coupling member freely rotatable around the outer tubular member.

2. An assembly of swimming pool cleaner components according to claim 1 in which the first end of the outer tubular member is tapered and the inner tubular member has a radially projecting rib adjacent the first end of the inner tubular member.

3. An assembly according to claim 2 which the tapered first end inserts over and holds the adjustably connecting means in position.

4. An assembly of swimming pool cleaner components according to claim 2 in which the means between the inner and outer tubular members comprises a radially and longitudinally contractible cantilever ring located between the tapered first end and the radially projecting rib.

5. An assembly of swimming pool cleaner components according to claim 1 in which the outer tubular member and body are in screwthreaded engagement with each other.

6. An assembly of swimming pool cleaner components according to claim 1 in which the outer tubular member has a second flange, and a stop projecting radially therefrom and the coupling member comprises a collar having a first flange, the collar located between the second flange and the stop.

7. An assembly of swimming pool cleaner components according to claim 6 in which the collar further comprises an axial thrust ball bearing located between the first flange on the collar and the second flange on the outer tubular member.

8. An assembly of swimming pool cleaner components according to claim 7 in which the ball bearing further comprises a lower and upper ring each having a plurality of open ended ball receiving formations formed therein with a ball located within each pair of opposing ball receiving formations.

9. An assembly of swimming pool cleaner components according to claim 8 in which the balls and ball receiving formations are moulded from acetyl synthetic resin.

10. An assembly of swimming pool cleaner components according to claim 1 in which the inlet end of the diaphragm is in frictional engagement with the body and has a flange which abuts against the axial inlet to the body.

11. An assembly of swimming pool cleaner components comprising:
   a. a body having an inlet and an outlet through which fluid passes;

b. a removable valve positioned within the body for periodically interrupting fluid flow therethrough;
c. a first tube;
d. means for coupling the first tube to the valve;
e. a second tube surrounding the first tube and having a first end adjustably positioned in the outlet of the body and a second end coupled to a hose; and
f. a collar positioned on the second tube for allowing relative rotation of the body and hose, the collar comprising a first flange and means for absorbing thrust.

12. An assembly of swimming pool cleaner components according to claim 11 in which the first tube has a series of ribs.

13. An assembly of swimming pool cleaner components according to claim 11 further comprising a second flange located on the second tube and the absorbing means comprises a bearing located between the first and second flanges.

14. An assembly of swimming pool cleaner components according to claim 11 in which the valve comprises a tubular diaphragm having an inlet end that is in frictional engagement with the body and a flange which abuts against the inlet to the body.

15. An assembly for providing intermittent fluid flow comprising:
a. a body having an inlet and an outlet through which fluid passes and a removable valve for periodically interrupting fluid flow through the body;
c. a first tube, coupled to the valve;
d. a second tube, surrounding the first tube and having a tapered inner end and a first flange;
e. a longitudinally and radially contractible cantilever ring located between the first and second tubes;
f. a collar, positioned on the second tube for allowing rotation of a hose connected to the second tube, the collar comprising a second flange; and
g. means, located between the first and second flanges, for absorbing thrust.

16. An assembly for providing intermittent fluid flow according to claim 15 in which the tapered inner end inserts over and exerts pressure on the cantilever ring.

* * * * *